US008641382B2

(12) United States Patent
Weber et al.

(10) Patent No.: US 8,641,382 B2
(45) Date of Patent: Feb. 4, 2014

(54) TURBOCHARGER

(75) Inventors: Mathias Weber, Frankenthal (DE); Jochen Zuck, Bad Kreuznach (DE); Dietmar Metz, Meckenheim (DE)

(73) Assignee: BorgWarner Inc., Auburn Hills, MI (US)

( * ) Notice: Subject to any disclaimer, the term of this patent is extended or adjusted under 35 U.S.C. 154(b) by 1626 days.

(21) Appl. No.: 12/094,819

(22) PCT Filed: Nov. 24, 2006

(86) PCT No.: PCT/EP2006/011298

§ 371 (c)(1),
(2), (4) Date: May 23, 2008

(87) PCT Pub. No.: WO2007/059995

PCT Pub. Date: May 31, 2007

(65) Prior Publication Data

US 2008/0260528 A1 Oct. 23, 2008

(30) Foreign Application Priority Data

Nov. 25, 2005 (EP) ..... 05025829

(51) Int. Cl.
*F01D 5/12* (2006.01)

(52) U.S. Cl.
USPC ..... 416/237; 416/223 A

(58) Field of Classification Search
USPC ..... 416/182, 183, 185, 188, 235, 237, 416/223 A, 223 B, DIG. 2
See application file for complete search history.

(56) References Cited

U.S. PATENT DOCUMENTS

| | | | | |
|---|---|---|---|---|
| 2,469,125 | A * | 5/1949 | Meisser | 416/183 |
| 2,484,554 | A * | 10/1949 | Concordia et al. | 416/188 |
| 3,964,840 | A * | 6/1976 | Kamelmacher | 416/183 |
| 4,243,357 | A * | 1/1981 | Flynn et al. | 415/218.1 |
| 5,088,894 | A * | 2/1992 | Patel | 416/219 R |
| 5,299,909 | A | 4/1994 | Wulf | |
| 5,364,228 | A * | 11/1994 | Henning et al. | 415/55.1 |
| 6,709,232 | B1 | 3/2004 | Vogiatzis | |
| 8,096,777 | B2 * | 1/2012 | Yokoyama et al. | 416/223 R |
| 8,517,664 | B2 * | 8/2013 | Sun et al. | 415/58.4 |
| 2005/0005603 | A1 * | 1/2005 | Stilgenbauer | 60/602 |
| 2005/0106013 | A1 * | 5/2005 | Ghizawi | 415/204 |
| 2008/0260528 | A1 * | 10/2008 | Weber et al. | 415/208.2 |

FOREIGN PATENT DOCUMENTS

| | | |
|---|---|---|
| CH | 305524 | 5/1955 |
| WO | 2004022922 A1 | 3/2004 |
| WO | 2005064121 A1 | 7/2005 |

* cited by examiner

*Primary Examiner* — Edward Look
*Assistant Examiner* — Christopher R Legendre
(74) *Attorney, Agent, or Firm* — William G. Anderson; Stephan A. Pendorf; Patent Central LLC

(57) ABSTRACT

A turbocharger includes a plurality of blades (7; 7') which are arranged in a turbine casing (2). Each blade has the following: a profile underside (8; 8') and a profile top side (9; 9') which determine the blade thickness, a blade leading edge (10; 10') at a first intersection of the blade underside (8; 8') and the blade top side (9; 9'), a blade trailing edge (11; 11') at a second intersection of the blade underside (8; 8') and the blade top side (9; 9'), a profile center line (12; 12') which is defined by the blade underside (8; 8') and the blade top side (9; 9') and runs between them from the blade leading edge (10; 11') to the blade trailing edge (11; 11'), and in which the profile center line (12; 12') runs in a wave-like manner.

11 Claims, 3 Drawing Sheets

TURBOCHARGER

The invention relates to a turbocharger, in particular a VTG exhaust-gas turbocharger.

Such a turbocharger is disclosed by U.S. Pat. No. 6,709,232 B1 (equivalent to EP 1 534 933 A1).

The advantages and the success of diesel engines with direct fuel injection in terms of drivability and low fuel consumption have been greatly assisted by the use of turbochargers having a turbine with adjustable guide vanes. This makes it possible to substantially increase the feasible operating range of the turbine, affording a higher level of efficiency compared to wastegate turbines.

In using a turbocharger with a variable turbine geometry (VTG), it is known that with straight blades (i.e. blades having a straight skeleton or profile center line and a symmetrical thickness distribution) efficiency limits are encountered at high levels of supercharging. This applies, in particular, to the engine starting range (low engine speed at full load). However, the straight blades can be said to have good characteristics in terms of their adjustability.

In order to compensate for said thermodynamic deficiencies of the straight blades, the aforementioned U.S. Pat. No. 6,709,232 B1 proposes to use curved and/or profiled blades. When these blades are in a closed state, that is to say when the blades are in very close proximity to one another, the arrangement of generic type disclosed by the publication of prior art results in incorrect incident flows, which lead to variable moments acting either in the opening direction or in the closing direction of the blades. The speed distribution and the resulting static pressure distribution in the channel formed by two adjacent blades furthermore has an influence on the moment acting on the blades. This effect can also lead to an increase in the control hysteresis, which may lead to the loss of adjusting capacity, if the forces occurring exceed the forces of the adjustment facility.

The object of the present invention, therefore, is to create a turbocharger, which will afford good thermodynamic characteristics for the blades of its variable turbine geometry with an improved control characteristic.

A turbocharger as described herein can achieve this object. The turbocharger (1) includes a turbine housing (2), which has an exhaust gas intake opening (3) and an exhaust gas outlet opening (4). The turbocharger (1) further includes a turbine rotor (5), which is fixed on a shaft (6) and is arranged in the turbine housing (2). The turbocharger (1) also includes a plurality of blades (7; 7'), which are arranged in the turbine housing (2) between the exhaust gas intake opening (3) and the turbine rotor (5). Each blade has a blade underside (8; 8') and a blade top side (9; 9'), which define the blade thickness. Each blade also has a blade leading edge (10; 10') at a first intersection of the blade underside (8; 8') and the blade top side (9; 9'). Each blade also has a blade trailing edge (11; 11') at a second intersection of the blade underside (8; 8') and the blade top side (9; 9'). Further, each blade has a profile center line (12; 12'), which is defined by the blade underside (8; 8') and the blade top side (9; 9') and which runs between these from the blade leading edge (10; 10') to the blade trailing edge (11; 11'). The outline of the profile center line (12; 12') is undulating with two opposing antinodes (12A, 12B). One of the antinodes of the profile center line (12, 12') plotted on an X-Y system of coordinates is an area (12B) which begins at the blade leading edge (10, 10') and which between the blade leading edge (10) and a zero passage of the profile center line (12) through the X axis has negative Y values. The second of the antinodes of the profile center line (12, 12') is an area (12A) which from the zero passage of the profile center line (12, 12') through the X-axis to the blade trailing edge (11) always has positive Y values.

By using a turbocharger having the blade shape according to the invention, it is possible, in addition to an improvement in the thermodynamics, to significantly reduce the closing moment by reducing the overall pressure losses in the distributor ring. It is therefore possible to improve the control action whilst maintaining the axis of rotation of the blade.

In order to obtain opening moments, the axis of rotation must be shifted towards the blade leading edge. The blade geometry according to the invention here affords the advantage that the axis of rotation only has to be shifted by a smaller amount compared to the blades disclosed by the state of the art. A smaller overall radial space is therefore required than in known solutions.

The turbocharger can have additional features that can provide advantages. For instance, the blade (7) can have a trailing area (13) of the blade top side (9) that is curved. Alternatively, the blade (7') can have a trailing area (13') of the blade top side (9') that is flat. Further, the incident flow angle $\gamma$ preferably lies in a range from 10 degrees to 30 degrees.

The undulating profile center line of the blade according to the invention comprises two opposing antinodes. If this profile center line shape is plotted on an X-Y system of coordinates having a horizontal X-axis and vertical Y-axis, negative Y-values are first generated adjacent to the blade leading edge, these values changing to positive Y-values after passing through the X-axis, and the profile center line having a point of inflexion.

The result with regard to the thermodynamic characteristics is a modified orientation of the blade leading edge, which reduces the loss of energy due to impact, owing to the flatter incident flow against the blade leading edge.

This also results in lower velocities in the channels between the blades, which produces smaller flow losses, it being nevertheless possible to maintain an approximately constant deflection in a peripheral direction.

There is also a variation in the moments occurring in the "opening" direction, which is achieved due to lower velocities in the channel, the static pressure rising and thereby in conjunction with the point of inflexion producing a moment in the "opening" direction. This applies to the leading area of the blade underside and the trailing area of the blade top side.

If the trailing area 13' of the blade top side is of rectilinear shape, this results in an increase in the effective channel cross section.

This in turn results in smaller losses due to low velocities in the channel whilst maintaining the deflection in a peripheral direction.

This embodiment also results in a change in the moments occurring in the "opening" direction due to lower velocities in the channel, which in turn allows the static pressure to rise, which in conjunction with the point of inflexion produces a moment in the "opening" direction.

Embodiments can also be directed to a blade (7; 7') of a turbocharger (1). The turbocharger (1) has a turbine housing (2) with an exhaust gas intake opening (3) and an exhaust gas outlet opening (4). A turbine rotor (5) fixed on a shaft (6) is arranged is the turbine housing (2). The blade (7; 7') includes a blade underside (8; 8') and a blade top side (9; 9'), which define the blade thickness. The blade (7; 7') also includes a blade leading edge (10; 10') at a first intersection of the blade underside (8; 8') and the blade top side (9; 9'); the blade (7; 7') also includes a blade trailing edge (11; 11') at a second intersection of the blade underside (8; 8') and the blade top side (9; 9'). A profile center line (12; 12') is defined by the blade underside (8; 8') and the blade top side (9; 9') and which runs between these from the blade leading edge (10; 10') to the blade trailing edge (11; 11'). The outline of the profile center line (12; 12') is undulating with two opposing antinodes (12A; 12B). One of the antinodes of the profile center line (12; 12') plotted on an X-Y system of coordinates is an area (12B) which begins at the blade leading edge (10; 10') and which between the blade leading edge (10) and a zero passage of the profile center line (12) through the X axis has negative Y values. The second of the antinodes of the profile center line (12; 12') is an area (12A), which from the zero passage of the profile center line (12; 12') through the X-axis to the blade trailing edge (11) always has positive Y values.

Further details, advantages and features of the present invention are set forth in the following description of exemplary embodiments, with reference to the drawing, in which:

FIG. 1 shows a turbocharger 1 according to the invention in the form of a VTG exhaust-gas turbocharger.

Figure 1:
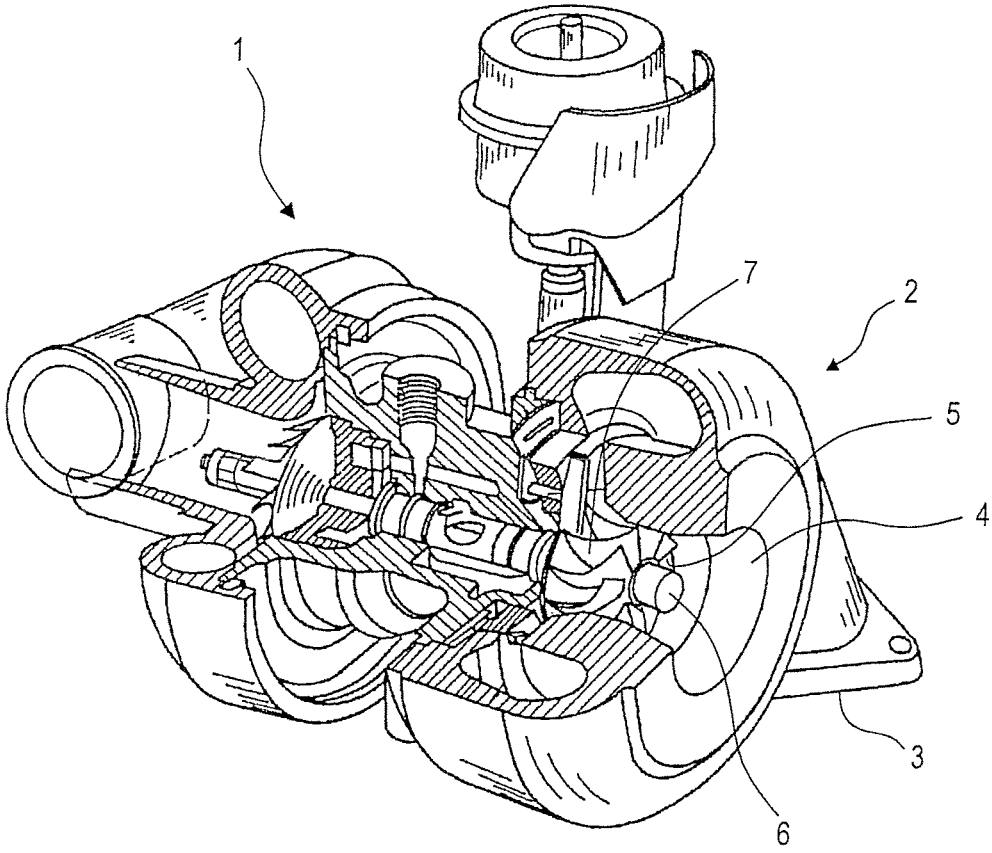
FIG. 1 shows a partially exploded, perspective view of a turbocharger according to the invention.

The turbocharger 1 has a turbine housing 2, which comprises an exhaust gas intake opening 3 and an exhaust gas outlet opening 4.

Also arranged in the turbine housing 2 is a turbine rotor 5, which is fixed on a shaft 6.

A plurality of blades, of which only the blade 7 can be seen in FIG. 1, is arranged in the turbine housing 2 between the exhaust gas intake opening 3 and the turbine rotor 5.

The turbocharger 1 according to the invention naturally also comprises all the other usual components of a turbocharger such as a compressor wheel, which is fixed on the shaft 6 and is arranged in a compressor housing, and the entire bearing unit, which are not described below, however, since they are not essential in order to explain the principles of the present invention.

Figure 2:
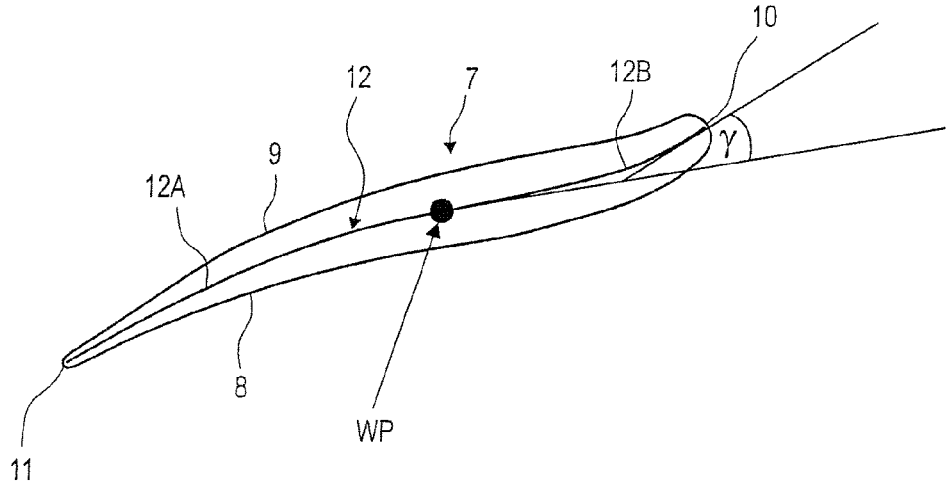
FIG. 2 shows a simplified representation of a first embodiment of a blade according to the invention for the adjustable turbine geometry of the turbocharger according to FIG. 1.

FIG. 2 shows a first embodiment of a blade 7 according to the invention.

The blade 7 has a blade underside 8, which in the fitted state is the blade side facing the turbine rotor 5.

The blade 7 furthermore has a blade top side 9, which together with the blade underside 8 defines the thickness of the blade 7.

In the position of the blade 7 represented in FIG. 2 the blade underside 8 and the blade top side 9 merge in a blade leading edge 10 on the right-hand side and blade trailing edge 11 on the left-hand side.

The blade underside 8 and the blade top side 9 define a profile center line 12; which is situated between them and is also referred to as the skeletal line. As FIG. 2 shows, in the embodiment represented this profile center line 12 has two areas 12A and 12B curved in opposite directions, the configuration of which gives the profile center line 12 an undulating contour, the areas 12A and 12B each being formed in the manner of antinodes. FIG. 2 also shows that the profile center line 12 has a point of inflexion WP, and FIG. 2 also shows the position of the incident flow angle γ at the blade leading edge 10, which is also referred to as the nose of the profile of the blade 7. The incident flow angle γ is the acute angle of the tangent to the profile center line 12 at the point of inflexion and of the tangent to the profile center line 12B at the blade leading edge 10.

Figure 3:
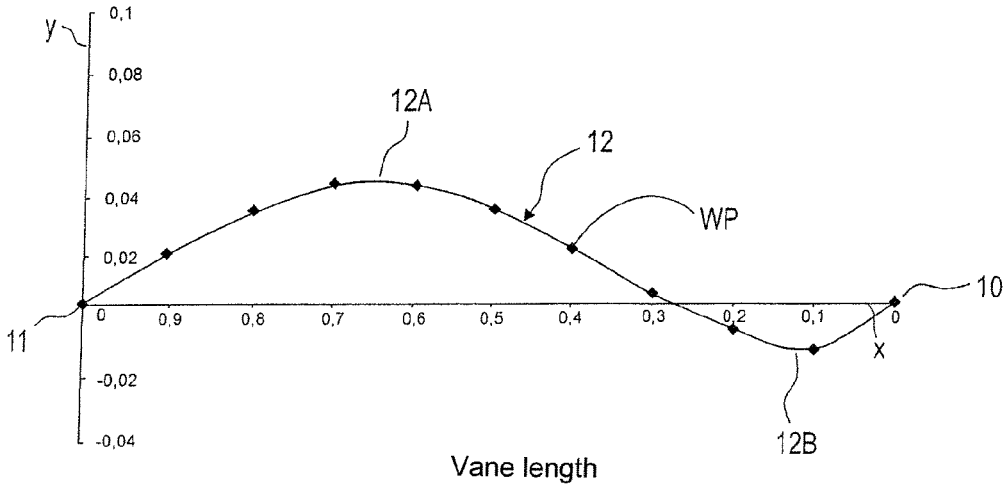
FIG. 3 shows an X-Y system of coordinates, on which the shape of the profile center line or skeletal line of the blade in FIG. 2 is represented.

In FIG. 3 the outline of the profile center line 12 is plotted on an X-Y system of coordinates, the X-axis representing the blade length of the blade 7.

The graph of the profile center line 12 shows the area 12B beginning at the blade leading edge 10, which has negative Y values between the blade leading edge 10 (X=0, Y=0) and the zero passage (X≈0.27; Y=0). The zero passage preferably lies in a range between X=0.10 and X=0.40.

From said zero passage onwards the second area 12A always has positive values up to the blade trailing edge 11 (X=1, Y=0). The point of inflexion WP occurs at a value of approximately X=0.4; Y=0.02).

FIG. 3 represents an outline of the profile center line or skeletal line 12, formed as perpendicular distance to the chord, which is formed by linear connection of the blade leading edge and the blade trailing edge and which represents the length of the blade.

Figure 4:
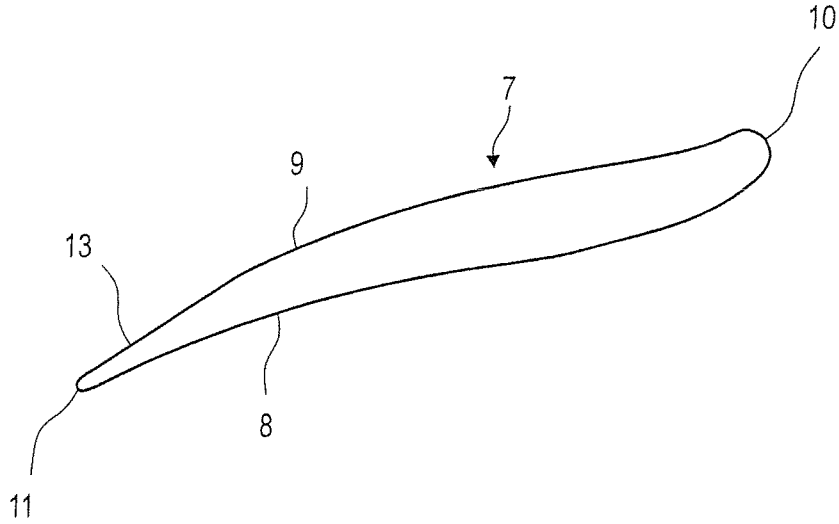
FIGS. 4 and 5 show further design variants of the blade in FIG. 2.
Figure 5:
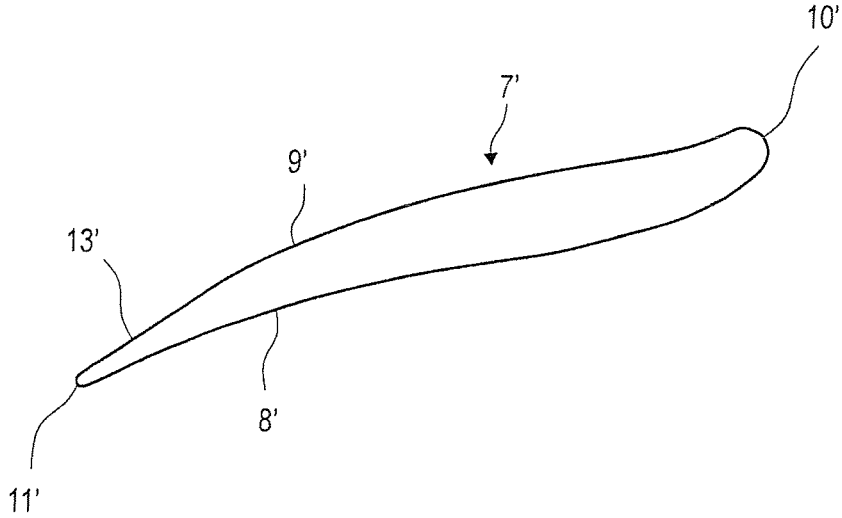

FIGS. 4 and 5 represent two basically feasible design variants of the blade 7 according to FIG. 2. In the embodiment according to FIG. 4 the top side 9 is curved in the area 13 adjoining the blade trailing edge 11. In FIG. 5 this area is identified by the reference numeral 13' and is flattened, that is to say not curved but flat in shape.

In addition to the verbal description, explicit reference is also made to the drawing for disclosure of the features of the present invention.

LIST OF REFERENCE NUMERALS

1 turbocharger
2 turbine housing
3 exhaust gas intake opening
4 exhaust gas outlet opening
5 turbine rotor
6 shaft
7, 7' blades
8, 8' blade underside (lower guide faces)
9, 9' blade top side (upper guide faces)
10, 10' blade leading edge
11, 11' blade trailing edge
12, 12' profile center line (skeletal line)
12A, 12B antinodes of the profile center line 12
13, 13' trailing areas of the profile top side 9 and 9'
WP point of inflexion
γ incident flow angle

The invention claimed is:

1. A turbocharger (1) comprising:

a turbine housing (2), which has an exhaust gas intake opening (3) and an exhaust gas outlet opening (4);

a turbine rotor (5), which is fixed on a shaft (6) and is arranged in the turbine housing (2); and a plurality of blades (7; 7'), which are arranged in the turbine housing (2) between the exhaust gas intake opening (3) and the turbine rotor (5), each blade having:

a blade underside (8; 8') and a blade top side (9; 9'), which define the blade thickness, a blade leading edge (10; 10') at a first intersection of the blade underside (8; 8') and the blade top side (9; 9'), a blade trailing edge (11; 11') at a second intersection of the blade underside (8; 8') and the blade top side (9; 9'), a profile center line (12; 12'), which is defined by the blade underside (8; 8') and the blade top side (9; 9')

and which runs between these from the blade leading edge (10; 10') to the blade trailing edge (11; 11'), the outline of the profile center line (12; 12') is undulating with two opposing antinodes (12A, 12B), and when the profile center line (12, 12') is plotted on an X-Y system of coordinates with the blade leading edge at Y=0 and the blade trailing edge at Y=0:

one of the antinodes of the profile center line (12, 12') is an area (12B) which begins at the blade leading edge (10, 10') and which between the blade leading edge (10) and a zero passage of the profile center line (12) through the X axis has negative Y values, and the second of the antinodes of the profile center line (12, 12') is an area (12A), which from the zero passage of the profile center line (12, 12') through the X-axis to the blade trailing edge (11) always has positive Y values wherein the area (12A) from the zero passage of the profile center line (12; 12') through the X-axis to the blade trailing edge (11) is greater than the area (12B) from the blade leading edge (10) and the zero passage of the profile center line (12) through the X-axis.

2. The turbocharger as claimed in claim 1, wherein the blade (7) has a trailing area (13) of the blade top side (9), which is curved.

3. The turbocharger as claimed in claim 1, wherein the blade (7') has a trailing area (13') of the blade top side (9'), which is flat.

4. The turbocharger as claimed in claim 1, wherein the blade (7, 7') has an incident flow angle γ associated therewith, and wherein the incident flow angle γ lies in a range from 10° to 30°.

5. The turbocharger as claimed in claim 1, wherein the one of the antinodes of the profile center line (12, 12') is located along the X-axis at a distance between about 10% to about 20% of the blade length from the blade leading edge (10; 10').

6. The turbocharger as claimed in claim 1, wherein the second of the antinodes of the profile center line (12, 12') is located along the X-axis at a distance between about 60% to about 70% of the blade length from the blade leading edge (10; 10').

7. The turbocharger as claimed in claim 1, wherein the one of the antinodes of the profile center line (12, 12') is located along the X-axis at a distance between about 10% to about 20% of the blade length from the blade leading edge (10; 10'), and wherein the second of the antinodes of the profile center line (12, 12') is located along the X-axis at a distance between about 60% to about 70% of the blade length from the blade leading edge (10; 10').

8. The turbocharger as claimed in claim 1, wherein the profile center line (12, 12') includes an inflection point (WP), and wherein the inflection point (WP) is located along the X-axis at a distance of about 40% of the blade length from the blade leading edge (10; 10').

9. The turbocharger as claimed in claim 1, wherein the zero passage of the profile center line (12) is located along the X-axis at a distance between about 10% to about 40% of the blade length from the blade leading edge (10; 10').

10. The turbocharger as claimed in claim 9, wherein the zero passage of the profile center line (12) is located along the X-axis at a distance of about 27% of the blade length from the blade leading edge (10; 10').

11. A blade (7; 7') of a turbocharger (1), which turbocharger (1) has a turbine housing (2) with an exhaust gas intake opening (3) and an exhaust gas outlet opening (4), in which a turbine rotor (5) fixed on a shaft (6) is arranged, the blade (7) comprising:

a blade underside (8; 8') and a blade top side (9; 9'), which define the blade thickness, a blade leading edge (10; 10') at a first intersection of the blade underside (8; 8') and the blade top side (9; 9'), a blade trailing edge (11; 11') at a second intersection of the blade underside (8; 8') and the blade top side (9; 9'), a profile center line (12; 12'), which is defined by the blade underside (8; 8') and the blade top side (9; 9') and which runs between these from the blade leading edge (10; 10') to the blade trailing edge (11; 11'), the outline of the profile center line (12; 12') is undulating with two opposing antinodes (12A; 12B), and when the profile center line (12, 12') is plotted on an X-Y system of coordinates with the blade leading edge at Y=0 and the blade trailing edge at Y=0:

one of the antinodes of the profile center line (12; 12') is an area (12B) which begins at the blade leading edge (10; 10') and which between the blade leading edge (10) and a zero passage of the profile center line (12) through the X axis has negative Y values, and the second of the antinodes of the profile center line (12; 12') is an area (12A), which from the zero passage of the profile center line (12; 12') through the X-axis to the blade trailing edge (11) always has positive Y values wherein the area (12A) from the zero passage of the profile center line (12; 12') through the X-axis to the blade trailing edge (11) is greater than the area (12B) from the blade leading edge (10) and the zero passage of the profile center line (12) through the X-axis.

* * * * *